United States Patent [19]

Guntly

[11] Patent Number: 4,684,484

[45] Date of Patent: Aug. 4, 1987

[54] PRIMER SYSTEM AND METHOD FOR PRIMING AN INTERNAL COMBUSTION ENGINE

[75] Inventor: Thomas G. Guntly, Hartford, Wis.

[73] Assignee: Tecumseh Products Company, Tecumseh, Mich.

[21] Appl. No.: 866,767

[22] Filed: May 27, 1986

[51] Int. Cl.[4] ..... F02M 1/16

[52] U.S. Cl. ..... 261/35; 261/37; 261/DIG. 8; 261/DIG. 68

[58] Field of Search ..... 261/DIG. 8, DIG. 68, 261/35, 37

[56] References Cited

U.S. PATENT DOCUMENTS

| | | | |
|---|---|---|---|
| 2,985,161 | 5/1961 | Seegrist | 123/180 |
| 3,177,920 | 4/1965 | Phillips | 158/36.4 |
| 3,201,096 | 8/1965 | Barr | 261/41 |
| 3,233,652 | 2/1966 | Phillips | 158/36.4 |
| 3,272,143 | 9/1966 | Rice | 103/150 |
| 3,275,305 | 9/1966 | Nutten | 261/34 |
| 3,371,658 | 3/1968 | Turner | 123/187.5 |
| 3,451,383 | 6/1969 | Nelson | 123/187.5 |
| 3,494,343 | 2/1970 | Nutten | 123/187.5 |
| 3,519,098 | 7/1970 | Plaga, Jr. | 181/57 |
| 3,743,254 | 7/1973 | Tuckey | 261/34 |
| 3,767,173 | 10/1973 | Ishii | 261/36 A |
| 3,805,758 | 4/1974 | May | 123/139 |
| 3,948,589 | 4/1976 | DuBois | 417/487 |
| 3,978,839 | 9/1976 | DuBois | 123/187.5 R |
| 3,983,857 | 10/1976 | O'Connor | 123/187.5 R |
| 3,987,775 | 10/1976 | O'Connor | 123/187.5 R |
| 4,001,354 | 1/1977 | Tuckey | 261/35 |
| 4,197,825 | 4/1980 | Altenbach | 123/187.5 R |
| 4,203,405 | 5/1980 | Schultz et al. | 123/187.5 R |
| 4,204,511 | 5/1980 | Morris | 123/187.5 R |
| 4,228,110 | 10/1980 | Magnet | 261/37 |
| 4,271,093 | 6/1981 | Kobayashi | 261/34 |
| 4,284,040 | 8/1981 | Baltz et al. | 123/187.5 R |
| 4,286,553 | 9/1981 | Baltz et al. | 123/187.5 R |
| 4,294,779 | 10/1981 | Alape | 261/35 |
| 4,335,061 | 6/1982 | Kobayashi | 261/44 G |
| 4,343,719 | 8/1982 | Stevens et al. | 252/359 |
| 4,373,479 | 2/1983 | Billingsley et al. | 123/187.5 R |
| 4,375,206 | 3/1983 | Baltz et al. | 123/187.5 R |
| 4,404,933 | 9/1983 | Kuczenski | 123/187.5 R |
| 4,414,163 | 11/1983 | Barr et al. | 261/69 A |
| 4,437,448 | 3/1984 | Billingsley | 123/577 |
| 4,447,370 | 5/1984 | Kobayashi et al. | 261/35 |
| 4,462,346 | 7/1984 | Haman et al. | 123/73 A |
| 4,498,434 | 2/1985 | Baltz et al. | 123/187.5 R |
| 4,508,068 | 4/1985 | Tuggle et al. | 123/187.5 R |

*Primary Examiner*—Tim Miles

*Attorney, Agent, or Firm*—Jeffers, Hoffman & Niewyk

[57] ABSTRACT

A priming system for the carburetor-fuel pump of an internal combustion engine. The priming system includes a manually actuatable primer that is connected through a primer check valve either directly to a fed orifice in the carburetor throat or through the metering chamber, which communicates with the carburetor throat through main and idle orifices. In one embodiment, successive actuations of the primer bulb functions to purge the fuel pump, primer and priming lines of air and fill them with liquid fuel so that continued pumping injects priming fuel into the carburetor throat. In an alternative embodiment, the fuel pump, primer and priming lines are similarly charged but the metering chamber is also charged with fuel and the excess fuel is pumped therethrough and into the carburetor throat through the main and idle orifices. The metering chamber is left with an excess charge of fuel that results in richer operation during cranking and initial engine operation.

16 Claims, 14 Drawing Figures

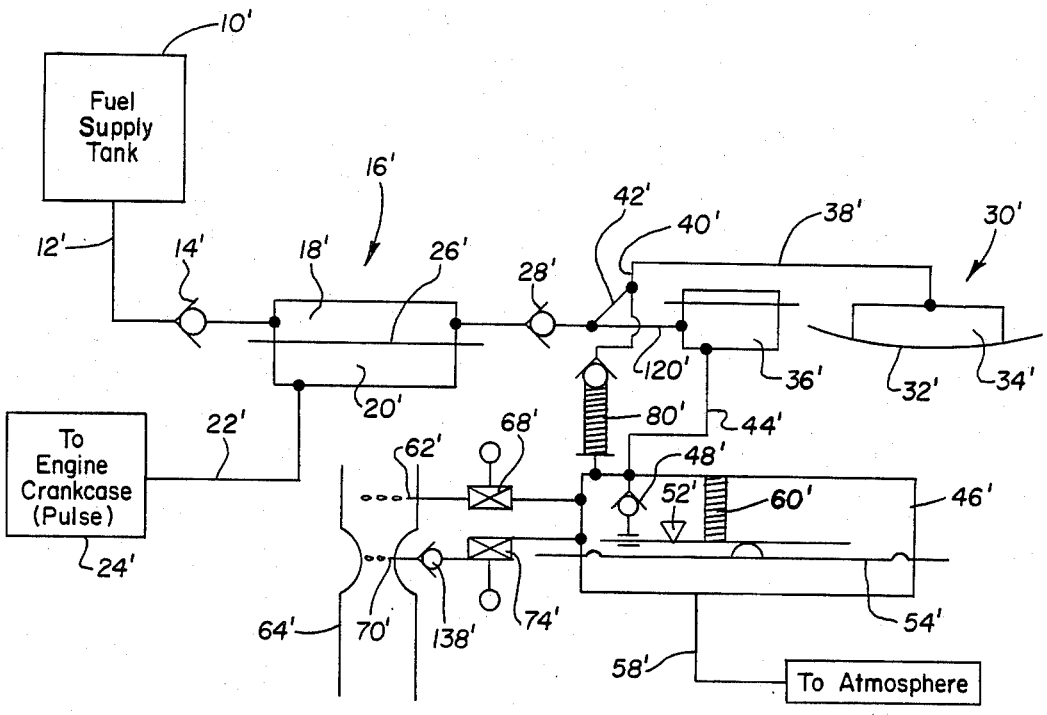
Fig. 6
Fig. 7
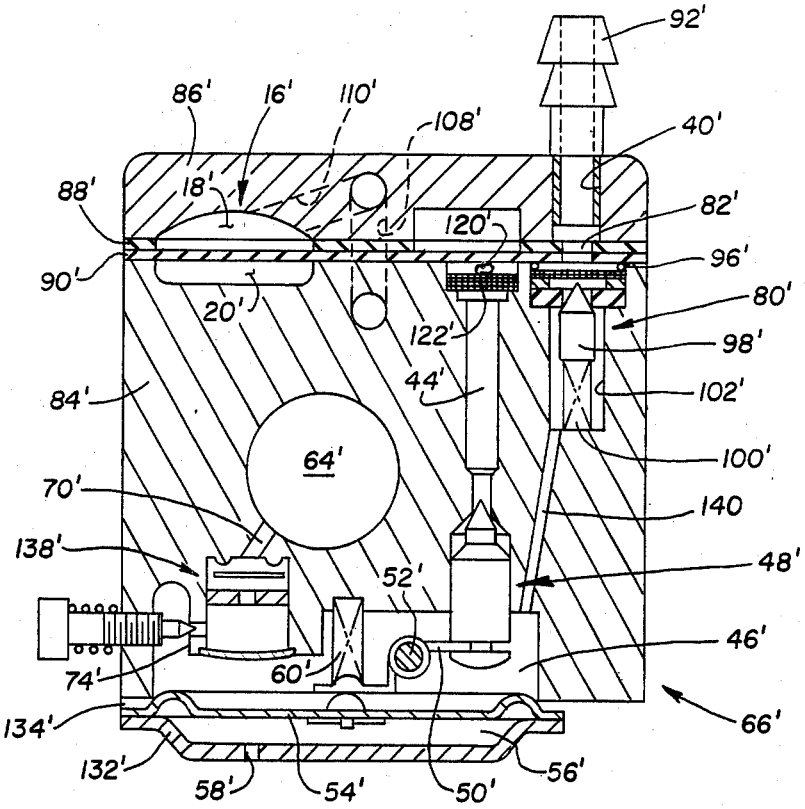

PRIMER SYSTEM AND METHOD FOR PRIMING AN INTERNAL COMBUSTION ENGINE

BACKGROUND OF THE INVENTION

The invention relates to a priming system for an internal combustion engine and a method of priming an internal combustion engine in order to facilitate easy starting of the engine.

With present day diaphragm carburetors which utilize a metering lever and fulcrum, it has proven to be difficult to adapt an efficient priming system to said carburetors. These carburetors are presently modified for priming by adding a primer fitting to the diaphragm cover, a primer line and primer pump with a primer bulb vented to atmosphere. On some engines, the bulb is sealed and the vent is in the metering diaphragm cover.

With this type of system, when the operator presses the primer bulb, the vent is closed and this pressurizes the atmospheric side of the metering diaphragm thereby pushing it against the metering lever causing the inlet valve to be opened against the metering spring which biases the valve closed. This diaphragm action forces fuel out of the metering chamber through the idle and main fuel feed orifices, into the induction tract, and further, some fuel is forced past the open inlet needle and is blocked by the outlet check valve in the fuel pump. Because the metering chamber and diaphragm are usually quite small due to size limitations on small power equipment, the total fuel displacement per diaphragm stroke will be minimal. The inlet needle valve opening is minimal due to such a small travel of the needle and as soon as the pressure drops in the metering chamber, the metering diaphragm retracts to its static position causing the inlet valve to close and shut off fuel delivery to the metering chamber.

In order for fuel to enter the metering chamber while the inlet valve is open, the fuel supply tank must be sufficiently above the carburetor for gravity to force feed the chamber. As the primer bulb is released and resumes its original shape, the atmosphere vent is uncovered and pressure is reduced at the diaphragm and in the metering chamber. This pressure reduction can aid in drawing fuel into the metering chamber, but once the diaphragm has retracted, the metering lever, following the diaphragm causes the inlet needle valve to fully close and only a small quantity of fuel will enter the chamber. This type of priming system often requires as many as twenty actuations of the manual primer to prime a dry fuel system from the tank to the carburetor, and often another six to eight primes will be required to supply enough fuel to the induction system for a cool weather engine start. This system is also ineffective when utilized with a closed fuel system wherein the fuel tank is under vacuum such as with a vacuum opening tank vent and is inoperative when the fuel tank is below the carburetor.

Attempts to prime from the inlet side of the metering valve through the metering chamber and main or idle orifices have proven to be unsatisfactory. If the cracking pressure for the metering valve is set too high, it requires a considerable amount of force on the priming bulb to overcome the resistance of the metering valve spring. On the other hand, if the cracking pressure is set too low, it may leak during normal engine operation or due to vibration thereby causing the mixture to become too rich.

SUMMARY OF THE INVENTION

The present invention, in one form thereof, provides a priming system for an internal combustion engine wherein the primer bulb line, the inlet passage and the primer passage are all connected to the outlet side of the fuel pump outlet check valve. The priming line is connected through a check valve to the priming orifice and the inlet or metering valve of the diaphragm carburetor is connected to the inlet line. The cracking pressure of the primer check valve is substantially lower than the cracking pressure of the inlet valve so that actuation of the primer bulb will force fuel through the primer check valve and into the induction system of the engine. As the primer bulb is operated, air is first purged from the fuel line, fuel pump, primer bulb line and primer passageway, and subsequent actuations of the primer bulb will fill the primer bulb, fuel pump and primer line completely with fuel, at which point subsequent actuations will force liquid fuel into the throat of the carburetor. When the engine is started, the inlet valve opens and the fuel pump, which is preferably of the pulse-type, is full of fuel and will immediately begin to pump fuel into the metering chamber, which fuel is then drawn into the engine induction system. Because the priming fuel bypasses the metering chamber, priming fuel can be introduced into the engine induction system with fewer actuations of the primer bulb. Furthermore, the cracking pressure of the primer check valve can be made quite low thereby enabling easier priming.

In another form of the invention, priming is accomplished through the metering chamber by means of a priming passage connected to the outlet side of the primer pump, through a priming check valve and into the metering chamber parallel to the inlet passage for the metering chamber. As the primer bulb is repeatedly actuated, air will be forced through the primer valve, metering chamber and main and idle orifices, and at the same time fuel will be drawn through the fuel pump and begin to fill the passages and primer bulb. When the metering chamber has been filled with fuel, which will occur after a relatively small number of actuations of the primer bulb, excess fuel will be forced into the engine induction system through the main and idle orifices. At the same time, the diaphragm, which is convoluted, will be stretched beyond its normal rest position, and although it will rebound, it will not rebound to its original static position. Thus, the metering chamber volume is left increased beyond the normal static or engine running volume, which will supply a rich fuel-air mixture on initial starting of the engine. After the engine has been operated for a short period, the additional charge of fuel in the metering chamber will be depleted and normal, leaner fuel mixture conditions will prevail. The engine can also be primed after starting by manually pumping excess fuel into the metering chamber, which will again charge the metering chamber beyond its normal quantity of fuel and produce a richer fuel-air mixture.

The present invention in one form thereof, provides a primer system for an internal combustion engine and a method of priming an internal combustion engine wherein the entire liquid fuel system of the engine from the fuel supply tank to and including the carburetor is filled during priming in order to facilitate easy starting of the engine. The priming system also provides for the delivery of liquid fuel directly into the carburetor induction system for subsequent intake into the engine combustion chamber for the purpose of providing a starting prime charge to facilitate easy starting of the engine.

The priming system also provides a manually actuatable means of delivering a quantity of liquid fuel directly into the induction system for subsequent intake into the engine combustion chamber for the purpose of providing an enriched fuel-air mixture, as required, in order to sustain initial cold engine operation and eliminate stall outs. Further, the priming system and method for priming provides an means of delivering a precise predetermined quantity of liquid fuel into the induction system for subsequent intake into the engine combustion chamber for the purpose of providing an enriched fuel-air mixture in order to sustain initial cold engine operation and eliminate stall outs.

The priming system is designed so that there is flexibility in the amount of fuel which can be delivered to the engine induction system for starting with a minimal number of manual primer actuations. With the present priming system the operator can, in many cases, fill the entire fuel system and prime the engine for starting in two to four actuations of the manual primer actuator.

The present priming system also does not require that the fuel tank be mounted above the carburetor since a gravity feed fuel system is not required. Consequently, the fuel tank can be mounted below the engine, if desired from a design standpoint, with no loss in priming efficiency. The priming system can also be utilized with a fuel tank having a normally sealed design with venting to the atmosphere achieved by a vacuum opening vent. Further, a vent hole is not required in the manual primer actuator so moisture and dirt contaminants will not enter the system through the hole and cause carburetor prime system malfunctions. The manual primer actuator volume, primer line volume, primer valve cracking pressure and the primer feed orifice size can all be varied so as to achieve a desired quantity and quality of prime charge.

The invention, in one form thereof, is a carburetion system for an internal combustion engine comprising a diaphragm carburetor including a carburetor body, an air-fuel passage in the carburetor body adapted to communicate with an engine combustion chamber, a fuel metering chamber in the carburetor body in communication with the air-fuel passage and a fuel pump including a fuel chamber in the carburetor body. The metering chamber communicates with the fuel pump chamber and air-fuel passage. The carburetion system includes a manually actuatable primer pump including a variable volume chamber, a fuel pump outlet check valve having an inlet side connected to the fuel pump and an outlet side connected to the primer pump chamber, a priming passageway in the carburetor body connected to the air-fuel passage and a primer check valve having an inlet connected to the primer pump chamber and an outlet connected to the priming passageway. An inlet passageway in the carburetor body communicates between the outlet side of the fuel pump outlet check valve and the metering chamber.

The carburetion system, in accordance with another form of the invention, comprises a diaphragm carburetor including a carburetor body, an air-fuel passage in the carburetor body adapted to communicate with an engine combustion chamber, a fuel metering chamber in the carburetor body communicating with an air-fuel passage through an orifice and a fuel pump including a fuel chamber in the carburetor body. The carburetor system includes a manually actuatable primer pump including a variable volume chamber, a fuel pump outlet check valve having an inlet side connected to the fuel pump and an outlet side communicating with the primer pump chamber, and a primer check valve having an inlet connected to the outlet side of the fuel pump check valve and an outlet side connected to the metering chamber, the primer check valve having a predetermined cracking pressure. A diaphragm operated inlet valve having an inlet connected to the outlet side of the fuel pump and having an outlet connected to the metering chamber has a cracking pressure whereby the inlet valve opens when the diaphragm reacts to a pressure drop in the metering chamber pushing against the metering lever. The inlet valve static cracking pressure being higher than the primer valve cracking pressure. The primer pump is operative for pumping fuel through the primer check valve and metering chamber into the air-fuel passage.

The present invention further provides a method for priming a carburetion system having a diaphragm carburetor with a metering chamber communicating with an air-fuel passage connected to the combustion chamber of an engine and a fuel pump having inlet and outlet check valves, the metering chamber including a movable diaphragm forming one wall thereof. The method comprises providing first and second passages between the fuel pump outlet check valve and the carburetor metering chamber, providing a primer check valve in the first passage having a first cracking pressure and providing an inlet valve in the second passage having a second static cracking pressure greater than the first pressure. Fuel is manually pumped only through the first passage primer check valve into the metering chamber to fill the metering chamber and then fuel is continued to be pumped into the metering chamber to pressurize the metering chamber and cause excess fuel to be injected from the metering chamber into the air-fuel passage.

It is an object of the present invention to provide a priming system for a carburetor which, in one form thereof, fills the entire liquid fuel system with fuel in order to facilitate easy starting of the engine. It is a further object of the present invention to provide a priming system for a carburetor wherein priming can be achieved through a relatively small number of actuations of the primer pump, and wherein priming can continue after the engine is running.

Yet another object of the present invention is to provide a priming system for a diaphragm-type carburetor wherein the metering chamber is charged with excess fuel during priming thereby resulting in a richer mixture on start-up or during cold engine running conditions.

BRIEF DESCRIPTION OF THE DRAWINGS

FIG. 6 is a schematic view of the fuel delivery system in accordance with a second embodiment of the invention;

FIG. 7 is a sectional view of the carburetor-fuel pump assembly shown in FIG. 6;

DETAILED DESCRIPTION OF PREFERRED EMBODIMENTS

Figure 1:
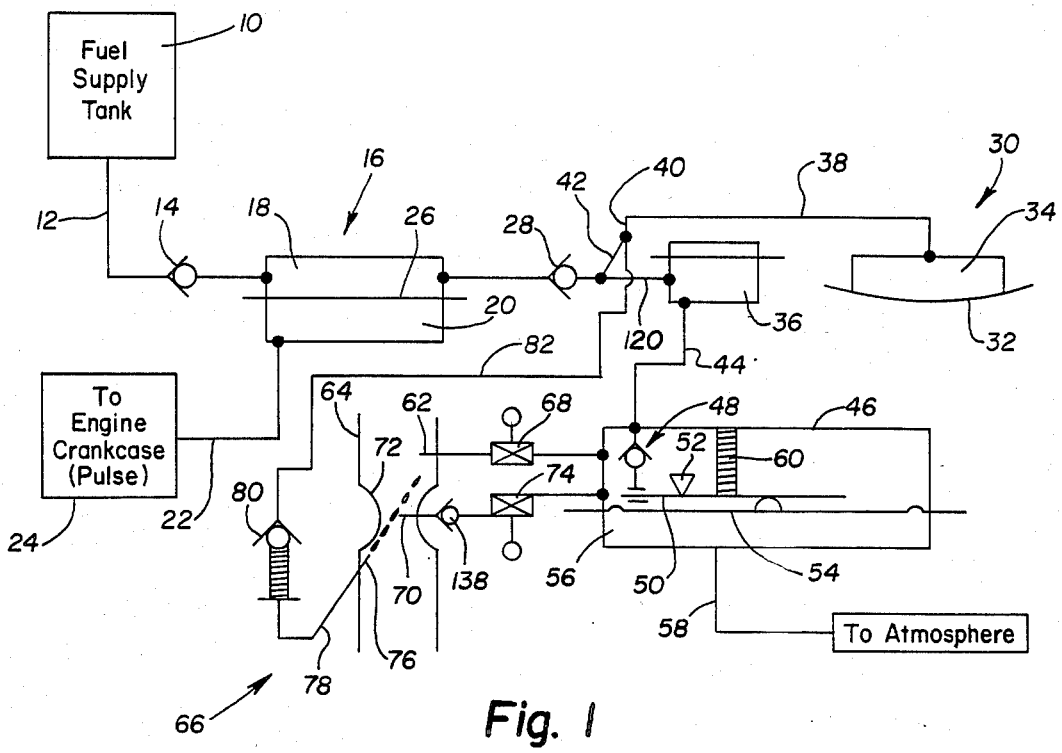
FIG. 1 is a schematic diagram of a fuel delivery system incorporating one embodiment of the present invention.

Referring now to FIG. 1 of the drawings, fuel supply tank 10 is connected by fuel line 12 and inlet check valve 14 to fuel pump 16, which is of the pulse-type comprising a fuel chamber 18 and a pulse chamber 20, the latter connected by a passage 22 to the engine crankcase 24. In a known manner, pulses developed in the crankcase of the engine intermittently pressurize pulse chamber 20, which causes diaphragm 26 to move relative to fuel chamber 18 thereby pumping fuel from fuel supply tank 10 out through outlet check valve 28. Primer pump 30 comprises a bulb, bellows or other actuator 32 comprising a variable volume chamber 34, and is connected to surge chamber 36 by tubing 38, passage 40, passage 42 and passage 120.

Inlet passage 44 connects surge chamber 36 to metering chamber 46 through inlet valve 48. Valve 48 opens and closes under the control of metering lever 50 to meter fuel into metering chamber 46 depending on the pressure and fuel conditions within metering chamber 46. Metering lever 50 is supported on pivot 52 and is actuated by the movement of diaphragm 54 in a manner well known in the art. The lower chamber 56 of metering chamber 46 is vented to the atmosphere through an opening 58. Metering spring 60 biases inlet valve 48 closed against the action of diaphragm 54.

Idle port 62, which opens into the throat portion 64 of carburetor 66, is connected to chamber 46 through idle adjustment valve 68. Main fuel port 70 opens into the venturi portion 72 of carburetor throat 64 and is connected to metering chamber 46 through main check valve 138 and adjustment valve 74. Carburetor throat 64 is part of the induction system for the internal combustion engine (not shown) to which the fuel pump-carburetor 66 is connected. When a vacuum is drawn on carburetor throat 64 by the engine, fuel is drawn into throat 64 through main and idle ports 70 and 62. Also opening into carburetor throat 64 is priming orifice 76, which is connected by passageway 78 and priming check valve 80 to passages 82 and 42 connected to passageway 40.

Referring now to FIGS. 2–5, 10–12 and 13, carburetor-fuel pump 66 is shown in greater detail. It comprises a carburetor body 84, a cover portion 86 and a gasket 88 and resilient diaphragm membrane 90 sandwiched between cover 86 and body 84. Primer tubing fitting 92 connects to passageway 40, which is connected to passage 42, which is connected to passage 120, the latter being connected to surge chamber 36.

Figure 2:
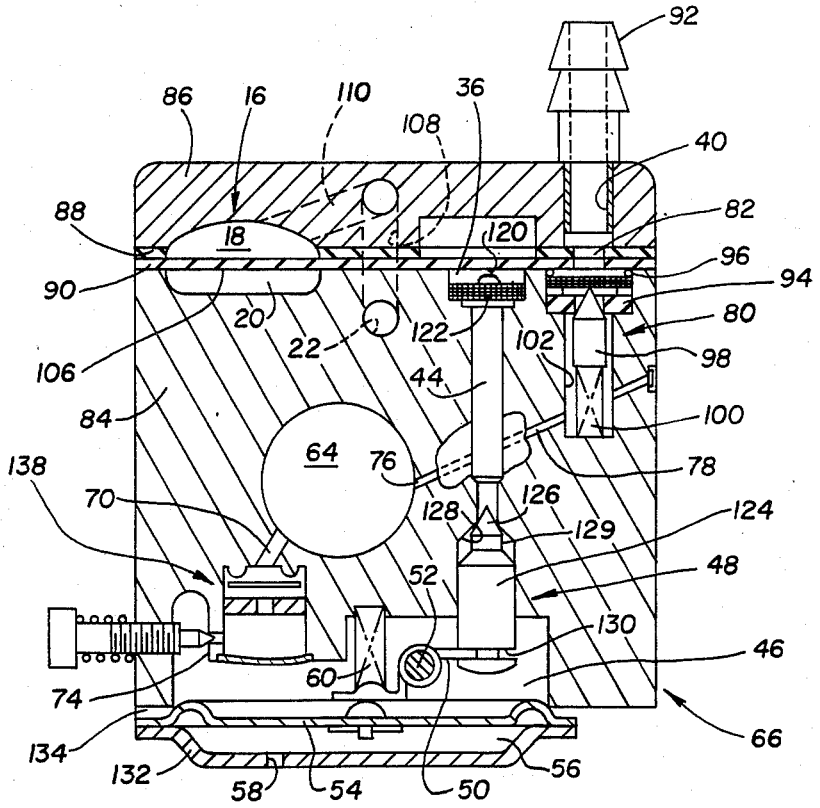
FIG. 2 is a sectional view of the carburetor-fuel pump assembly taken along line 2—2 of FIG. 3.
Figure 3:
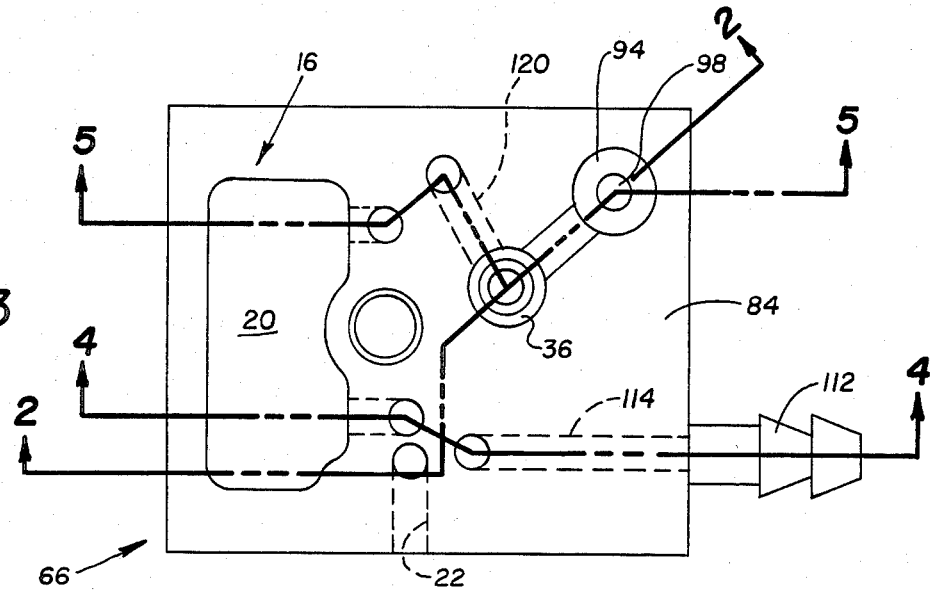
FIG. 3 is a top plan view of the carburetor-fuel pump assembly of FIG. 2 with the upper portion thereof removed to illustrate the details of construction.
Figure 5:
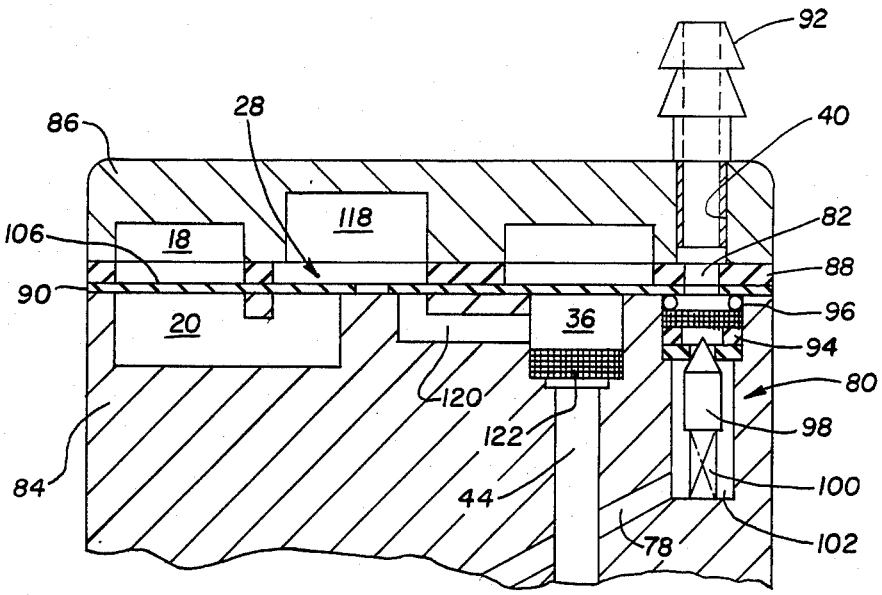
FIG. 5 is a sectional view of FIG. 3 taken along line 5—5 and viewed in the direction of the arrows.

Priming valve 80 comprises valve seat 94 disposed within cylindrical recess 96, valve 98 and valve spring 100, the latter being received within cylindrical recess 102. Spring 100 biases valve 98 into seating relationship with valve seat 94, thereby blocking the flow of fuel below a predetermined cracking pressure. When the preset cracking pressure of priming valve 80 is reached, which in this case is approximately 6 psi, then valve 80 opens and fuel flows through priming passageway 78 and port 76 into carburetor throat 64. FIGS. 2 and 5 illustrate the connection between passage 40 and valve 80.

Fuel pump 16 comprises chambers 18 and 20 formed in cover 86 and carburetor body 84, respectively, and the chambers are separated from each other by portion 106 of flexible membrane 90, which forms a diaphragm between chambers 18 and 20. Passage 22 from the engine crankcase (FIGS. 2 and 3) communicates with pulse chamber 18 through passages 108 and 110.

Figure 4:
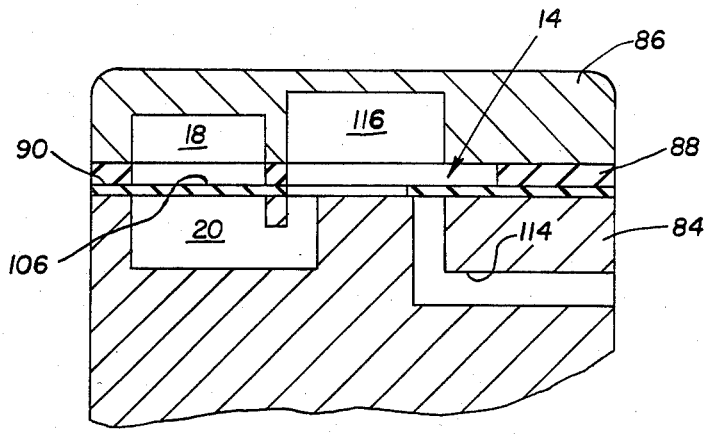
FIG. 4 is a sectional view of FIG. 3 taken along line 4—4 and viewed in the direction of the arrows.

With reference to FIG. 4, fuel is drawn into fuel chamber 20 of fuel pump 16 through fuel line fitting 112, passage 114, inlet check valve 14 and through transfer passage 116. Fuel is pumped from fuel chamber 20 through outlet check valve 28 (FIG. 5) through transfer passage 118 and passage 120 to surge chamber 36.

The fuel is pumped through fuel filter screen 122 and inlet passage 44 past inlet valve 48, which comprises valve body 124 received in valve recess 128 and preferably having an irregular cross-section, such as hexagonal. The upper portion 126 of valve 124 seats against shoulder 128 of inlet passage 44 when biased against it by spring 60 and metering arm 50, the latter being connected to valve body 48 by means of groove 130. Diaphragm 54 is sandwiched between carburetor body 84 and metering chamber cover 132 together with a gasket 134. Spring 60 biases metering lever 50 in a counterclockwise direction as indicated in FIG. 2 thereby seating valve 48 and preventing the flow of fuel from passage 44 into metering chamber 46. The chamber 56 formed between diaphragm 54 and cover 132 is at atmospheric pressure because of vent opening 58.

Metering chamber 46 communicates with carburetor throat 64 formed in carburetor body 84 through main mixture orifice 74, check valve 138 and main fuel port 70. Spring 60 normally closes valve 48, but when vacuum is created within carburetor throat 64 during starting and running conditions of the engine, the reduced pressure within chamber 46 will cause diaphragm 54 to move upwardly thereby rotating metering lever 50 clockwise and opening valve 48. When chamber 46 becomes filled with fuel, diaphragm 54 moves in a downward direction as viewed in FIG. 2, then valve 48 will be closed. The tension of spring 60 is such that the static cracking pressure of valve 48, that is, the pressure within inlet passage 44 acting on the upper portion 126 of valve body 124, exceeds 28 psi, for example, valve 48 will open. Since the typical output pressure of fuel pump 16 is approximately 2–3 psi, valve 48 will be opened only through the action of diaphragm 54 and not by normal pressure within inlet passage 44. As mentioned earlier, the cracking pressure of primer check valve 80 is approximately 6 psi.

The embodiment of FIGS. 1–5 operates as follows. With the carburetor-fuel pump system 66 completely dry, as primer bulb 32 is depressed, air in primer bulb 32 is forced out through tube 38, passage 40, passage 42 and transfer passage 118, thereby closing fuel pump outlet check valve 28. When the pressure within the expansible chamber 34 reaches a predetermined pressure, such as 6 psi, which occurs very soon after initial depression of the manual primer bulb 32 begins, primer check valve 80 opens and air flows through primer passageway 70 into carburetor throat 64. Primer feed orifice 76 preferably has a diameter of approximately 0.025 inches. Air continues to flow until pressure in the prime system drops below 6 psi, at which time the primer valve 80 closes, or until the primer bulb 32 is released, at which point a small vacuum will be drawn on the prime system. Because inlet valve 80 has a higher cracking pressure, for example 28 psi, it remains closed throughout the entire priming cycle.

When primer bulb 32 is released, expansible chamber 34 expands to its original volume, thereby producing a negative pressure in the prime system and placing a negative pressure at fuel pump outlet check valve 28. This opens the inlet valve 14 and outlet valve 28 of fuel pump 16 and closes primer check valve 80, thereby drawing fuel into fuel pump 16 from fuel supply tank 10. On subsequent actuations of primer bulb 32, fuel line 12, fuel pump 16, primer bulb 32, primer line 38 and passage 114, transfer passage 116, passage 40, passage 42, chamber 36, passage 120 and transfer passage 118 will be purged of air and filled with liquid fuel. At that point, subsequent actuations of primer bulb 32 will force fuel through priming passageway 78 and priming port 76 into carburetor throat 64. The prime fuel is now available to be inducted into the combustion chamber of the engine as the engine is cranked. It should be noted that priming can be accomplished even after the engine is running.

Figure 8:
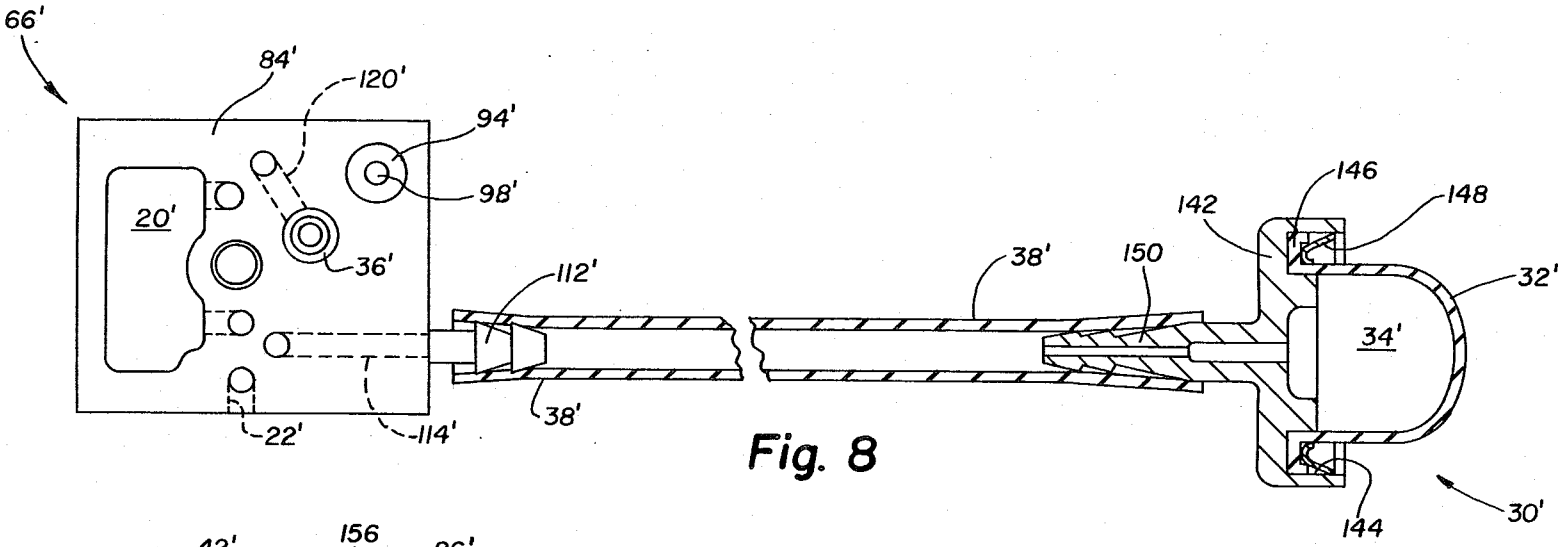
FIG. 8 is a top view of the carburetor-fuel pump assembly of FIG. 7 but with the upper portion thereof removed, and showing the primer bulb used to prime the system.

Referring now to FIGS. 6, 7 and 8, an alternative embodiment of the present invention is shown, wherein corresponding elements to those of the embodiment of FIGS. 1–5 are denoted by primed reference numerals. In the embodiment of FIGS. 6, 7 and 8, primer check valve 80' is connected to metering chamber 46' rather than being connected directly to carburetor throat 64', as was the case in the earlier discussed embodiment. As shown in FIG. 7, priming passageway 140 connects chamber 102' of primer check valve 80' to metering chamber 46'.

FIG. 8 illustrates primer assembly 30', which is identical in both embodiments, and which comprises a primer cup 142 including an annular groove 144 in which is received the flange portion 146 of resilient primer bulb 32'. Annular retainer clip 148 frictionally secures bulb 32' in place. Tubing 38', which may have a length of 4–6 inches, for example, connects the stepped portion 150 of primer 30' to fitting 112' on carburetor 66'. Preferably, primer bulb 32' and tubing 38' are made of a transparent material that the operator can visually determine when the priming system has been filled with fuel.

The embodiment of FIGS. 6, 7 and 8 operates as follows. As primer bulb 32' is depressed, air therein is forced outwardly through tubing 38' into passage 40 and 42' and transfer passage 118, thereby closing fuel pump outlet check valve 28'. When the air pressure inside chamber 34 reaches a pressure of 6 psi, for example, primer valve 80' opens and air begins to flow through primer feed orifice into metering chamber 46'. The metering chamber volume increases as metering diaphragm 54' expands outward while the remainder of the air charge is injected into the carburetor throat through the main and idle feed orifices 70' and 62'.

Air will continue to flow until the pressure in the prime system drops below 6 psi and primer valve 80' closes, or until primer bulb 32' is released. When the manual primer bulb 32' is released, it expands to its original shape causing negative pressure, which draws on tubing 38' thereby creating a negative pressure in fuel pump 16'. This opens inlet valve 14' and outlet valve 28' and draws fuel from fuel supply tank 10'.

As primer 30' is repeatedly actuated, the entire fuel supply system will be emptied of air and filled with fuel. At that point, each depression of primer 30' will force fuel past primer check valve 80' into metering chamber 46', thereby expanding the volume of chamber 46' as metering diaphragm 54' moves outwardly, and at the same time forcing fuel out of metering chamber 46' through main and idle feed orifices 70' and 62' into carburetor throat 64'. Fuel continues to flow out of metering chamber 46' momentarily after primer 30' has been released as metering diaphragm 54' returns toward its static position. However, due to the weight of fuel and resistance of the fuel to exit the small feed orifices within chamber 46', diaphragm 54' will not completely resume its original static position. Fuel will feed until pressure in metering chamber 46' is depleted and diaphragm 54' is unable to rebound against the weight of the remaining fuel, at which point the metering chamber volume is increased beyond its static or engine running volume due to the excess fuel therein. This process is repeated on each depression of primer 30' thereby leaving the metering chamber "charged" for starting. Continued depression of primer 30' will force excess fuel from metering chamber 46 through main and idle feed orifices 70' and 62' so that the amount of prime charge introduced into carburetor 64' is totally under the control of the operator.

Upon starting of the engine, following priming, initial starting and operation is assisted because the carburetor supplies a rich fuel/air mixture as a result of the excess fuel charge in metering chamber 46'. After the engine has been operated for a short period, the excess charge of fuel within metering chamber 46' is depleted and a normal leaner fuel mixture prevails. The engine can be primed during normal running conditions by again actuating primer 30', which will charge metering chamber 46' with excess fuel and force a certain portion of the excess fuel into carburetor throat 64 through orifices 62' and 70'.

Figure 9A:
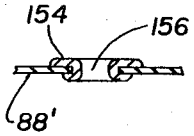
FIG. 9A is an enlarged fragmentary view of the grommet and gasket of FIG. 9.
Figure 9:
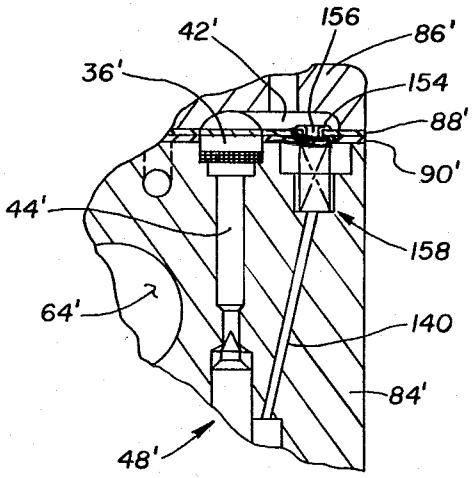
FIG. 9 is a fragmentary sectional view showing a modified primer check valve.
Figure 10:
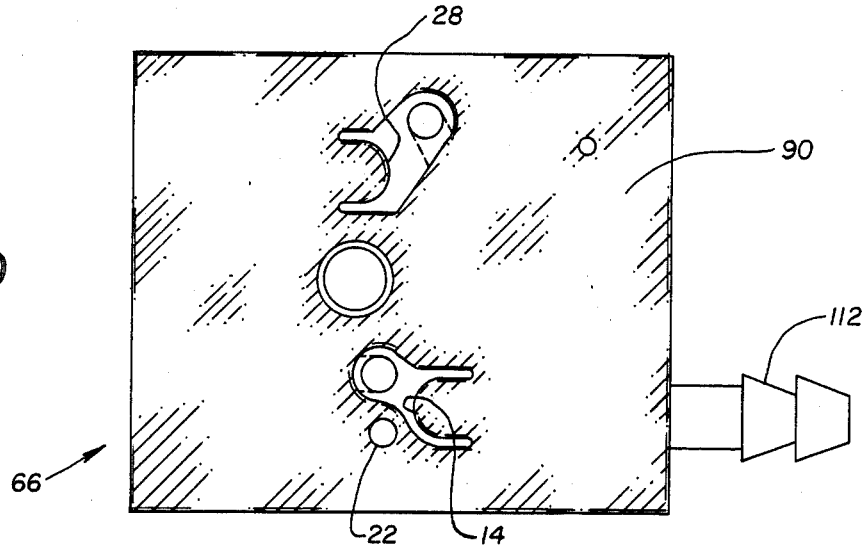
FIG. 10 is a top plan view of the carburetor-fuel pump assembly similar to FIG. 3 showing the rubber diaphragm in place.
Figure 11:
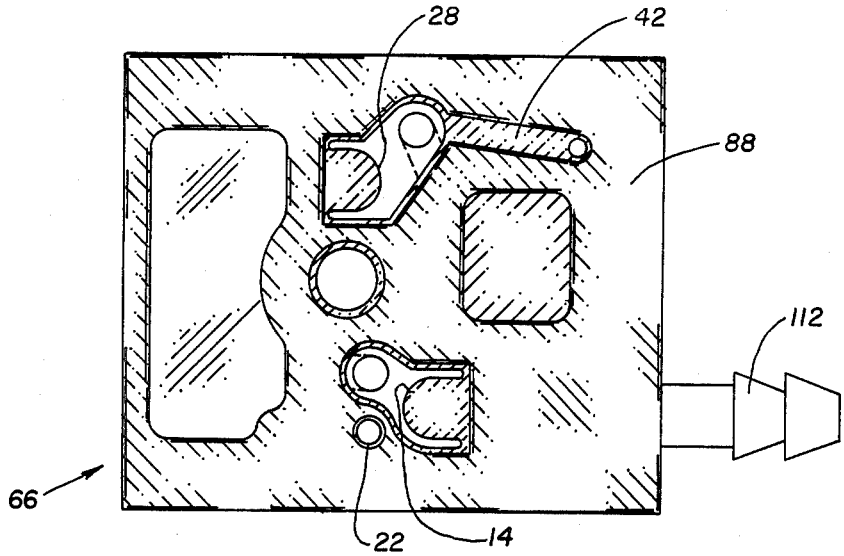
FIG. 11 is a top plan view of the carburetor-fuel pump assembly similar to FIG. 10 showing the gasket overlying the diaphragm.
Figure 12:
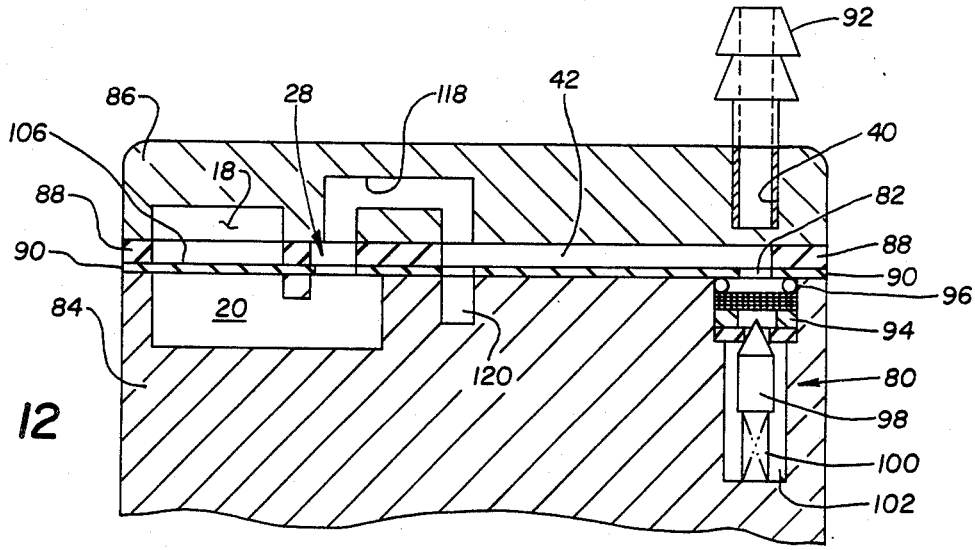
FIG. 12 is a sectional view similar to FIG. 5 but not taken through passage 120 and chamber 36.
Figure 13:
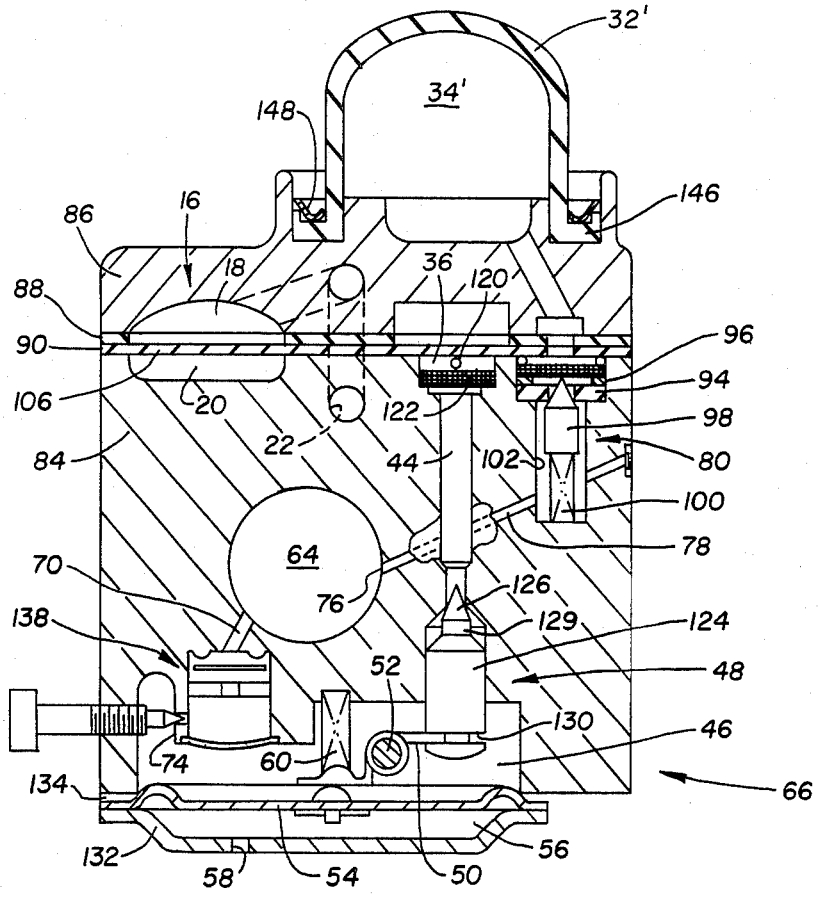
FIG. 13 is a sectional view of an alternative form of the carburetor-fuel pump assembly having an integral primer.

Alternative forms of primer check valve 80 are contemplated within the scope of the present invention. For example, rather than utilizing a needle valve 98' seating against a rubber seat 94', the valve can take the form of a ball made of steel, plastic or other rigid material again seating against a rubber seat. Alternatively, and with reference to FIGS. 9 and **9*a* gasket 88 could be provided with a steel eyelet 154 disposed within an opening 156 in gasket 88', and then hinging a portion of membrane 90' therebelow so that it opens and closes against the eyelet 154. A return spring 158 would maintain the valve flap 160 in seating engagement with the eyelet 154 until suitable cracking pressure has been developed in chamber 34**.

While this invention has been described as having a preferred design, it will be understood that it is capable of further modification. This application is, therefore, intended to cover all variations, uses, or adaptations of the invention following the general principles thereof and including such departures from the present disclosure as come within known or customary practice in the art to which this invention pertains and fall within the limits of the appended claims.

What is claimed is:

1. A carburetion system for an internal combustion engine comprising:

a diaphragm carburetor comprising a carburetor body, an air-fuel passage in the carburetor body adapted to communicate with an engine combustion chamber, a fuel metering chamber in the carburetor body in communication with said air-fuel passage and a fuel pump including a fuel chamber in the carburetor body, said metering chamber communicating with said fuel pump chamber and said air-fuel passage, a manually actuatable primer pump means comprising a variable volume chamber, a fuel pump outlet check valve having an inlet side connected to said fuel pump and an outlet side connected to said primer pump chamber, a priming passageway in said carburetor body connected to said air-fuel passage, a primer check valve having an inlet connected to said primer pump means chamber and an outlet connected to said priming passageway, and an inlet passageway in said carburetor body communicating between the outlet side of said fuel pump outlet check valve and said metering chamber.

2. The carburetion system of claim 1 including an inlet valve means connected between said metering chamber and said inlet passage for controlling fuel flow into said metering chamber, said metering chamber including a diaphragm means for operating said inlet valve.

3. The carburetion system of claim 1 including inlet valve means connected to said inlet passage for controlling fuel flow from said fuel pump to said metering chamber, said inlet valve means including diaphragm means in said metering chamber for controlling the flow of fuel into said metering chamber in response to the pressure in said metering chamber.

4. The carburetion system of claim 1 wherein said air-fuel passage includes a throat portion having a reduced diameter, and said priming passageway opens into said throat portion.

5. The carburetion system of claim 1 wherein said primer pump means comprises an unvented resilient bulb member, and said bulb member is connected to said priming passageway and said fuel pump outlet valve through a passage that is sealed to the ambient, whereby contaminants are prevented from entering said primer pump means.

6. The carburetion system of claim 1 wherein said primer check valve has a predetermined cracking pressure whereby said primer check valve opens when the pressure at its inlet is at about the cracking pressure, and including a diaphragm operated inlet valve means connected to said inlet passage for controlling the flow of fuel from said fuel pump to said metering chamber, said inlet valve means having a cracking pressure, and the inlet valve static cracking pressure is higher than the primer check valve cracking pressure, whereby actuation of the primer pump means will not pump fuel through the inlet valve means.

7. The carburetion system of claim 6 wherein said fuel pump is a pulse-type fuel pump having a maximum output pressure less than the cracking pressure of said primer check valve.

8. A carburetion system for an internal combustion engine comprising:

a diaphragm carburetor comprising a carburetor body, an air-fuel passage in the carburetor body adapted to communicate with an engine combustion chamber, a fuel metering chamber in the carburetor body in communication with said air-fuel passage and a fuel pump including a fuel chamber in the carburetor body, said metering chamber communicating with said fuel pump chamber and said air-fuel passage, a manually actuatable primer pump means comprising a variable volume chamber, a fuel pump outlet check valve having an inlet side connected to said fuel pump and an outlet side connected to said primer pump chamber, a priming passageway in said carburetor body connected between the outlet side of said fuel pump outlet check valve and said metering chamber, a primer check valve in said priming passageway for passing fuel from said primer pump means to said metering chamber when said primer pump means is actuated, an inlet passageway in said carburetor body communicating between the outlet side of said fuel pump check valve and said metering chamber, and a diaphragm controlled inlet valve means connected to said inlet passageway for controlling the flow of fuel from said fuel pump to said metering chamber in response to the pressure in said metering chamber.

9. The carburetion system of claim 8 wherein said primer pump means comprises an unvented resilient bulb member, and said bulb member is connected to said priming passageway and said fuel pump outlet valve through a passage that is sealed to the ambient, whereby contaminants are prevented from entering said primer pump means.

10. The carburetion system of claim 8 wherein said primer check valve has a predetermined cracking pressure whereby said primer check valve opens when the pressure at its inlet is at about the cracking pressure, said inlet valve means has a cracking pressure, and the inlet valve cracking pressure is higher than the primer valve cracking pressure whereby actuation of the primer pump means will not pump fuel through the inlet valve means.

11. The carburetion system of claim 10 wherein said fuel pump is a pulse-type fuel pump having a maximum output pressure less than the cracking pressure of said primer check valve.

12. A carburetion system for an internal combustion engine comprising:

a diaphragm carburetor comprising a carburetor body, an air-fuel passage in the carburetor body adapted to communicate with an engine combustion chamber, a fuel metering chamber in the carburetor body communicating with the air-fuel passage through an orifice, and a fuel pump including a fuel chamber in the carburetor body, a manually actuatable primer pump means including a variable volume chamber, a fuel pump outlet check valve having an inlet side connected to said fuel pump and an outlet side communicating with the primer pump means chamber, a primer check valve having an inlet connected to the outlet side of said fuel pump check valve and an outlet side connected to said metering chamber, said primer check valve having a cracking pressure whereby said primer check valve opens when the pressure at its inlet is at about the cracking pressure, a diaphragm operated inlet valve means having an inlet connected to the outlet side of said fuel pump check valve and an outlet connected to said metering chamber, said inlet valve means having a cracking pressure, the inlet valve static cracking pressure being higher than the primer valve cracking pressure, said primer pump means being operative for pumping fuel through said primer check valve and said metering chamber into the air-fuel passage.

13. The carburetion system of claim 12 wherein said fuel pump is-a pulse-type fuel pump having a maximum output pressure less than the cracking pressure of said primer check valve.

14. The carburetion system of claim 12 wherein said primer pump means comprises an unvented resilient bulb member, and said bulb member is connected to said fuel pump outlet valve through a passage that is sealed to the ambient, whereby contaminants are prevented from entering said primer pump means.

15. In a carburetion system for an internal combustion engine comprising a diaphragm carburetor having a metering chamber communicating with an air-fuel passage connected to the combustion chamber of an engine, the metering chamber including a movable diaphragm forming one wall thereof, and a fuel pump having inlet and outlet check valves, a method for priming the engine comprising:

providing first and second passages between the fuel pump outlet check valve and the carburetor metering chamber, providing a primer check valve in the first passage having a first cracking pressure and providing an inlet valve in the second passage having a second cracking pressure greater than the first pressure, manually pumping fuel only through the first passage and primer check valve into the metering chamber to fill the metering chamber and then continuing to pump fuel into the metering chamber to pressurize the metering chamber and cause excess fuel to be injected from the metering chamber into the air-fuel passage.

16. The method of claim 15 wherein the metering chamber remains expanded during the initial stage of starting and causes enrichment of the air fuel mixture during starting.

* * * * *